US006958674B2

(12) United States Patent
Tsuchida

(10) Patent No.: US 6,958,674 B2
(45) Date of Patent: Oct. 25, 2005

(54) CONNECTOR DEVICE EXCELLENT IN AIR-TIGHTNESS AND EGR SENSOR HAVING THE SAME

(75) Inventor: Yasuo Tsuchida, Miyai-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 58 days.

(21) Appl. No.: 10/423,500

(22) Filed: Apr. 25, 2003

(65) Prior Publication Data

US 2003/0214382 A1 Nov. 20, 2003

(30) Foreign Application Priority Data

May 14, 2002 (JP) ..... 2002-139073

(51) Int. Cl.[7] ..... H01C 1/012

(52) U.S. Cl. ..... 338/276; 338/176; 338/162; 338/221; 338/273; 439/736

(58) Field of Search ..... 338/162, 276, 338/322, 312, 273, 199, 221, 220; 439/736

(56) References Cited

U.S. PATENT DOCUMENTS

| | | | | | |
|---|---|---|---|---|---|
| 4,479,106 | A | * | 10/1984 | Shimizu et al. | 338/160 |
| 4,994,782 | A | * | 2/1991 | Watanabe et al. | 338/160 |
| 5,059,940 | A | * | 10/1991 | Thomas, Jr. | 338/164 |
| 5,433,628 | A | * | 7/1995 | Sadaishi et al. | 439/736 |
| 5,525,956 | A | * | 6/1996 | Hashizume et al. | 338/322 |
| 5,847,640 | A | * | 12/1998 | Fukaya et al. | 338/160 |
| 5,920,252 | A | * | 7/1999 | Nakagawa | 338/160 |
| 5,939,973 | A | * | 8/1999 | Imamura | 338/172 |
| 6,005,473 | A | * | 12/1999 | Ishihara | 338/167 |
| 6,034,590 | A | | 3/2000 | Ishihara | |
| 6,078,248 | A | * | 6/2000 | Yagi | 338/174 |
| 6,102,739 | A | | 8/2000 | Murakami | |
| 6,109,980 | A | * | 8/2000 | Tsunezawa et al. | 439/733.1 |
| 6,200,156 | B1 | * | 3/2001 | Hiraki et al. | 439/395 |
| 6,206,735 | B1 | * | 3/2001 | Zanolli | 439/736 |
| 6,587,029 | B2 | * | 7/2003 | Miyamoto | 338/273 |
| 6,628,193 | B2 | * | 9/2003 | Doi et al. | 338/162 |
| 2003/0214382 | A1 | * | 11/2003 | Tsuchida | 338/162 |
| 2004/0192117 | A1 | * | 9/2004 | Mott et al. | 439/736 |

FOREIGN PATENT DOCUMENTS

| | | |
|---|---|---|
| JP | 09/273904 | 10/1997 |

* cited by examiner

*Primary Examiner*—Karl D. Easthom
(74) *Attorney, Agent, or Firm*—Beyer Weaver & Thomas LLP

(57) ABSTRACT

A terminal plate is formed with a wide portion and a narrow portion. The wide portion, to be insert-molded by a housing of a synthetic resin, is opened by an elongate blank hole having an inner peripheral surface parallel with a side shape thereof, thereby forming two divisional parts on the both sides thereof. The divisional part is given by a width s1 narrower than a width s2 of the narrow portion, wherein the total width (s1×2) of the two divisional parts is made equal to the width s2 of the narrow portion. Grooves can be formed on the main and back surfaces of the divisional parts.

3 Claims, 7 Drawing Sheets

CONNECTOR DEVICE EXCELLENT IN AIR-TIGHTNESS AND EGR SENSOR HAVING THE SAME

BACKGROUND OF THE INVENTION

1. Field of the Invention

This invention relates to a connector device and EGR sensor having the same and, more particularly, to the structure of a terminal plate to be insert-molded in a housing of a synthetic resin.

2. Description of the Related Art

Conventionally, the gasoline-engine-mounted vehicle or the like has an EGR system for recycling part of emission gas toward the air intake, in order to reduce the NOx amount in emission gas. The EGR system has an EGR sensor in order for controlling the recycling amount of emission gas toward the air intake.

The EGR sensor, as shown in FIG. 6, is structured mainly with a housing 101 made of a synthetic resin, a cover 102 provided on an aperture of the housing 101, an operating shaft 103 slidably arranged to the cover 102 and having an outer end abutted against a not-shown EGR valve, a return spring 104 provided in the housing 101 and always urging the operating shaft 103 outward, a slider receiver 105 provided at an inner end of the operating shaft 103, a slider 106 attached to the slider receiver 105, a resistance board 107 provided in the housing 101 and for sliding the slider 106, a signal-transmission terminal plate 108 made of a metal having an intermediate part insert-molded in the housing 101 and one end connected to the resistance board 107, and a power-feed terminal plate 109 made of a metal having an intermediate part insert-molded in the housing 101 and both ends projecting outward of an end surface of the housing 101.

The power-feed terminal plate 109 is structured with a wide portion 109*a* and a narrow portion 109*b*, as shown in FIGS. 7A, 7B and 7C. The wide portion 109*a* and the narrow portion 109*b* are formed in respective constant widths. The wide portion 109*a*, at its tip, is formed with a slit 109*c* for inserting therein a terminal member (not shown) provided on one mating connector device. The narrow portion 109*b*, at its tip, is formed with a chamfer 109*d* for easy insertion to a terminal member (not shown) provided on the other mating connector device.

The power-feed terminal plate 109 is bent rectangular at a point of the narrow portion 109*b* close to the wide portion 109*a*, whereby insert-molding is made by a housing 101 in a range shown at the arrows in FIG. 7C.

In the meanwhile, in case the power-feed terminal plate 109 made of a metal is insert-molded by the synthetic-resin housing 101, cure contraction of the synthetic resin causes sink mark in the synthetic resin on the main and back surfaces of the power-feed terminal plate 109 as shown in FIG. 8, thus causing a clearance 110 between the power-feed terminal plate 109 and the housing 101. The clearance 110 has a width-a nearly equal to a width of the power-feed terminal plate 109 and a height-b increasing in proportion to the width of the terminal plate 109. Incidentally, FIG. 8 is a widthwise sectional view of the power-feed terminal plate 109.

The EGR sensor especially requires high air-tightness because there is a pressure of the emission gas being recycled from the exhaust pipe to air-intake pipe of the gasoline engine, exerted at a side set up with the cover 102 and operating shaft 103.

However, the related-art EGR sensor is not applied by an art for suppressing or eliminating the clearance 110 formed between the power-feed terminal plate 109 and the housing 101, involving a problem of not having a practically sufficient air-tightness.

Incidentally, although the above exemplified the case of a clearance formed on the main and back surfaces of the power-feed terminal plate 109, similar trouble occurs also on the main and back surfaces of the signal-transmission terminal plate 108.

Meanwhile, although the above exemplified the EGR sensor, the foregoing trouble is not unique to the EGR sensor, similar problem exists on every connector device that pressure exerts on an insert-mold part of terminal plate.

SUMMARY OF THE INVENTION

It is an object of the present invention to provide a connector device small in the clearance formed in an insert-mold part of terminal plate and excellent in air-tightness, and an EGR sensor having the same.

In order to achieve the foregoing object, the present invention provides a structure that a connector device comprises: a housing made of a synthetic resin; and a terminal plate made of a metal having an intermediate portion insert-molded in the housing and both ends projecting at an end surface of the housing; wherein an insert-mold part of the terminal plate is opened with a blank hole or slit having an inner peripheral surface parallel with a side shape of the insert-mold part, to have divisional parts divided by the blank hole or slit formed narrower in width than the end projecting at the end surface of the housing.

As described before, in the case that a terminal plate of a metal is insert-molded by a housing of synthetic resin, by cure contraction of the synthetic resin, the clearance formed on the main and back surfaces of the terminal plate is made nearly equal in width to a width of the terminal plate and a height increasing in proportion to the width of the terminal plate. Accordingly, in case a required blank hole or slit is opened in the insert-mold part of the terminal plate and the divisional parts divided by the blank hole or slit are made narrower in width than the end of the terminal plate projecting at the end surface of the housing, it is possible to relatively reduce the size of the clearance formed on the main and back surfaces of the terminal plate, and hence to improve the air-tightness of the connector device.

Also, the present invention provides a structure that the blank hole or slit has a lengthwise direction given in parallel with a lengthwise direction of the terminal plate in a connector device.

The clearance, formed on the main and back surfaces of the terminal plate due to cure contraction of the synthetic resin, is not necessarily constant in its length direction but varies in height due to local thermal conditions or mold-resin wall thickness. Accordingly, the longer the length in the divisional parts formed narrow in width the more effective for reducing the clearance formed in the insert-mold part. By directing a lengthwise direction of the blank hole or slit to a direction parallel with a lengthwise direction of the terminal plate, the divisional parts formed narrow in width can be made long, thus making the air-tightness of the connector device more favorable.

Also, the present invention provides a structure that the divisional parts have a total width given equal to a width of the end projecting at the end surface of the housing in a connector device.

In this manner, in case the total width of the divisional parts is given equal to the width of the end projecting at the end surface of the housing, even where the terminal plate is utilized as a power-feed terminal plate for supplying power to an EGR valve driving actuator, it is possible to secure a capacity satisfactory to flow a predetermined power amount. Accordingly, the connector device can be prevented against performance deterioration.

Also, the present invention provides a structure that one to a plurality of grooves are formed extending in a direction perpendicular to a lengthwise direction of the terminal plate, on the main and back surfaces of the divisional parts in a connector device.

In this manner, in case one to a plurality of grooves are formed, extending in a direction perpendicular to a lengthwise direction of the terminal plate, on the main and back surfaces of the divisional parts, the synthetic resin for insert-molding enters in the grooves. Because the clearance formed on the main and back surfaces of the terminal plate can be made complex in shape, it is possible to make the air-tightness of the connector device more favorable.

On the other hand, in order to achieve the foregoing object, the present invention provides a structure that an EGR sensor comprises: a housing made of a synthetic resin; an operating shaft slidably attached on the housing; position detecting means for detecting a position of the operating shaft; and a terminal plate made of a metal having an intermediate portion insert-molded in the housing and both ends projecting at an end surface of the housing; wherein an insert-mold part of the terminal plate is opened with a blank hole or slit having an inner peripheral surface parallel with a side shape of the insert-mold part, to have divisional parts divided by the blank hole or slit formed narrower in width than the end projecting at the end surface of the housing.

In this manner, in case a required blank hole or slit is opened in the insert-mold part of the terminal plate and the divisional parts divided by the blank hole or slit are made narrower in width than the end of the terminal plate projecting at the end surface of the housing, it is possible to relatively reduce the size of the clearance formed on the main and back surfaces of the terminal plate and hence to improve the air-tightness of the EGR sensor.

DESCRIPTION OF THE PREFERRED EMBODIMENT

Figure 1:
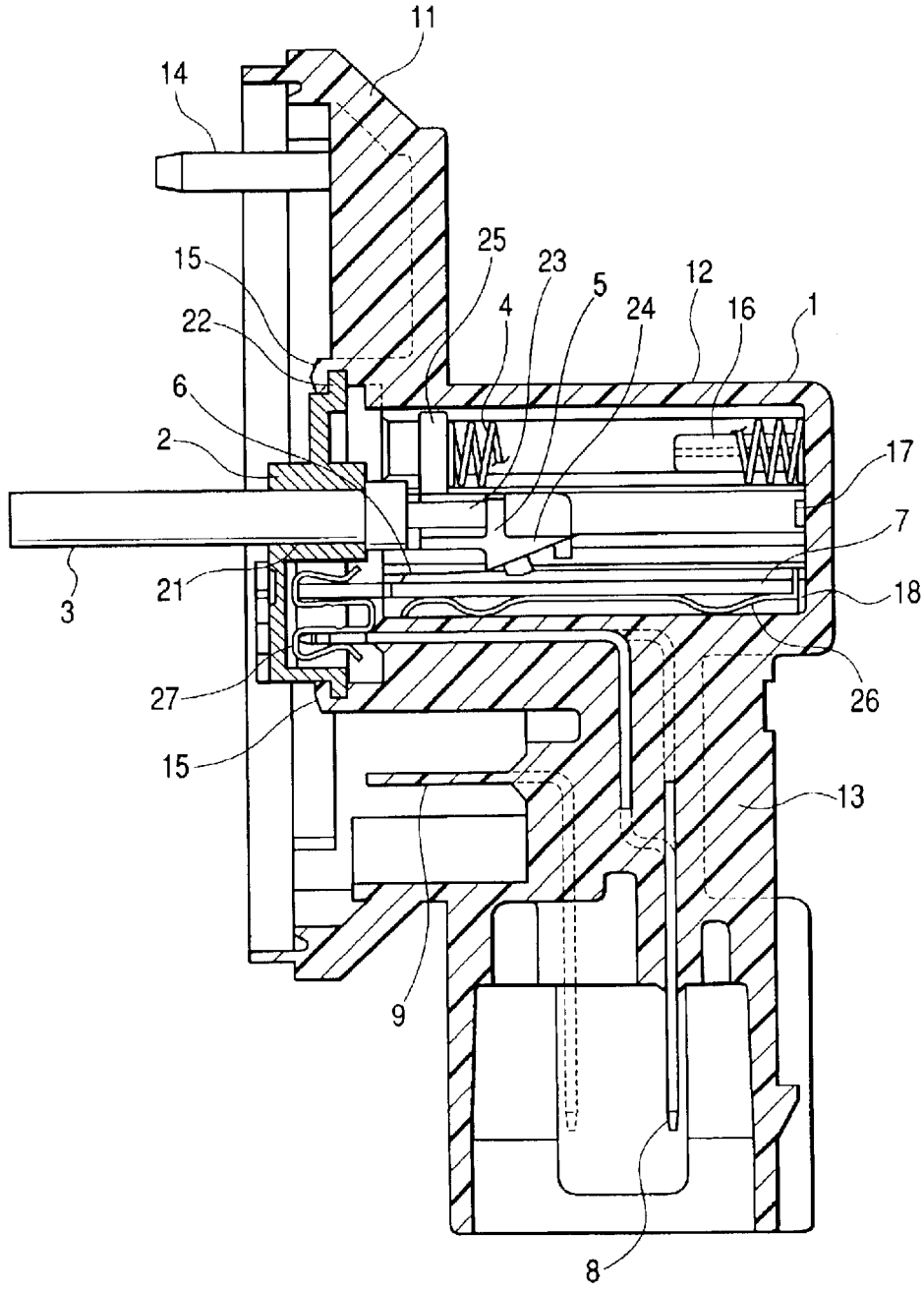
FIG. 1 is a sectional view of an EGR sensor according to an embodiment.
Figure 2B:
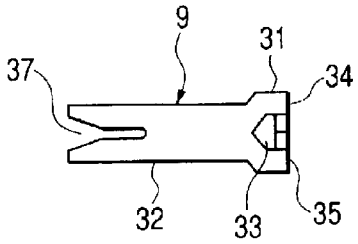
FIGS. 2A to 2C are a plan and side views of a terminal plate to be insert-molded to the EGR sensor of the embodiment.
Figure 2A:
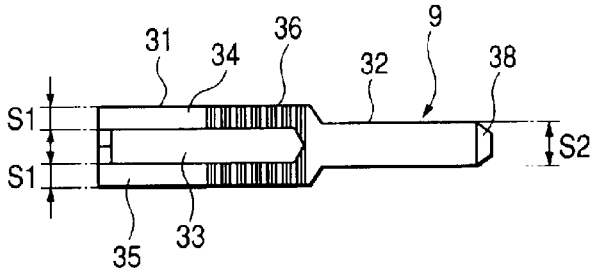
Figure 2C:
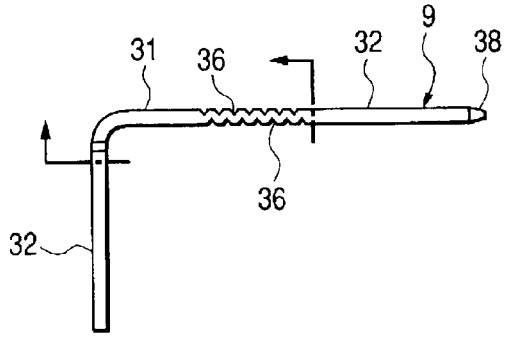
Figure 3:
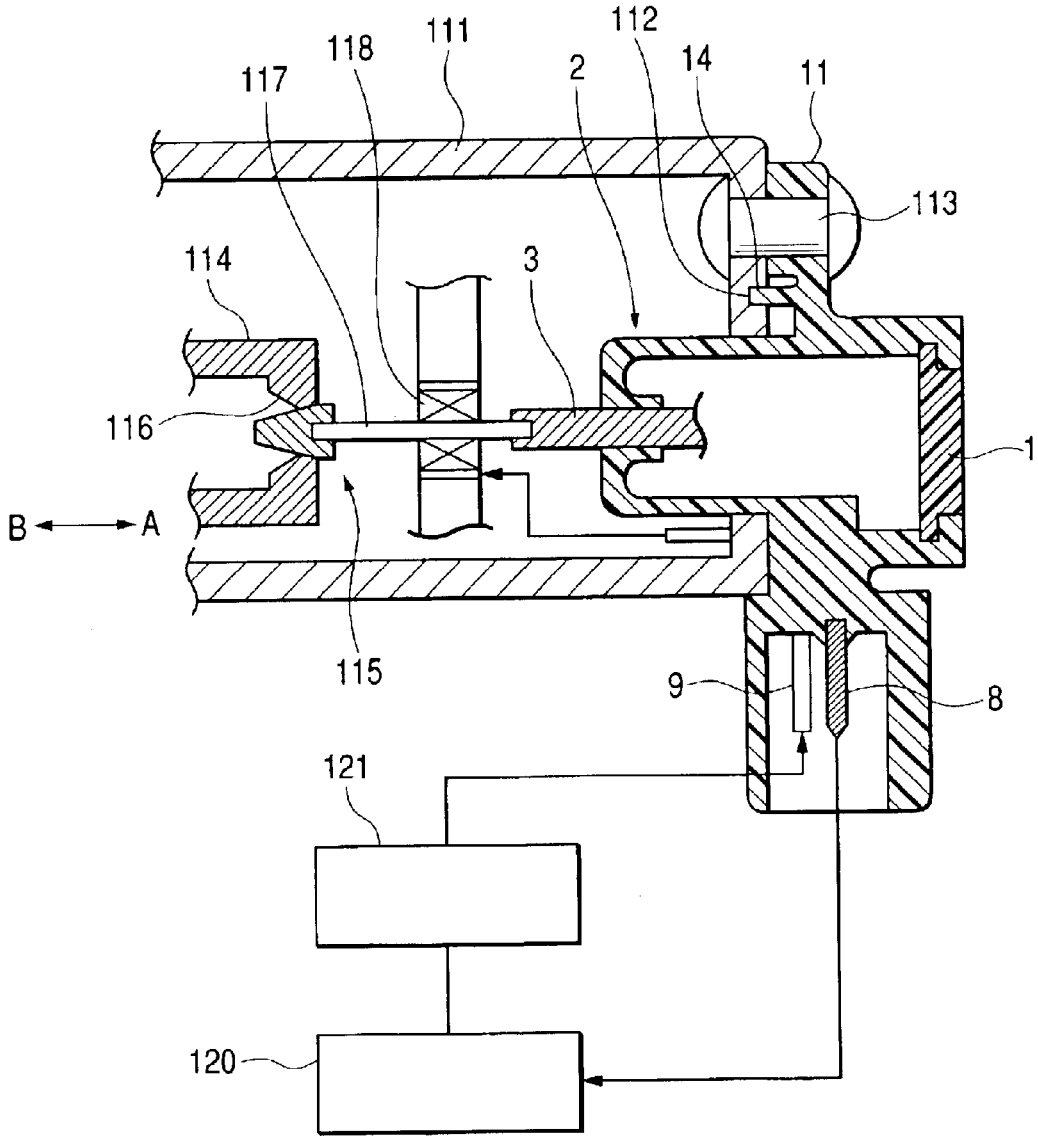
FIG. 3 is an explanatory view in a use state of the EGR sensor according to the embodiment.
Figure 4A:
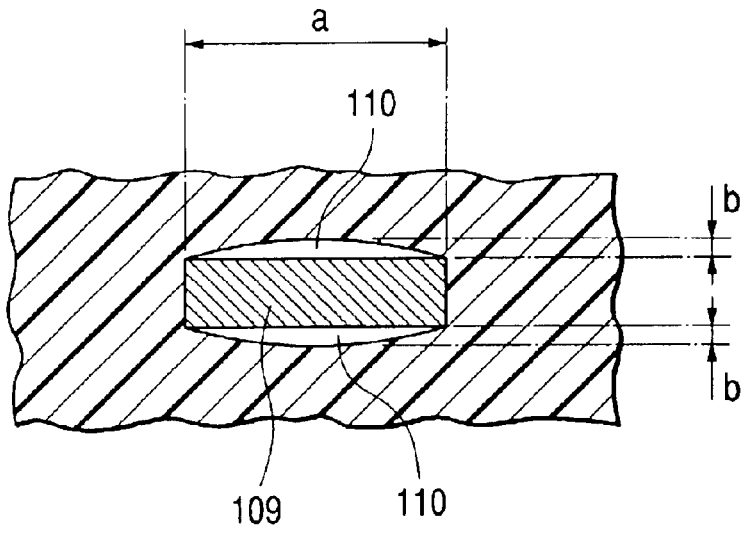
FIG. 4A PRIOR ART
FIGS. 4A and 4B are widthwise sectional views of terminals showing an effect of the EGR sensor of the embodiment in comparison with that of a EGR sensor of a related art.
Figure 4B:
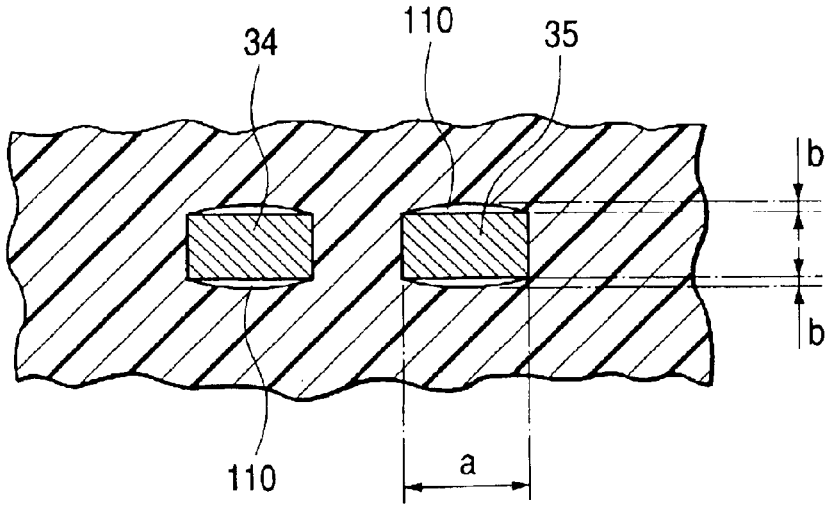

Explanations will be now made on one embodiment of an EGR sensor having a connector device according to the present invention, on the basis of FIGS. 1 to 4A and 4B. FIG. 1 is a sectional view of an EGR sensor according to the present embodiment, FIGS. 2A to 2C are plan and side views of a terminal plate to be insert-molded to the EGR sensor of the embodiment, FIG. 3 is an explanatory view in a use state of the EGR sensor of the embodiment, and FIGS. 4A and 4B are sectional views showing an effect of EGR sensor of the embodiment in comparison with a the EGR sensor of the related art.

Figure 6:
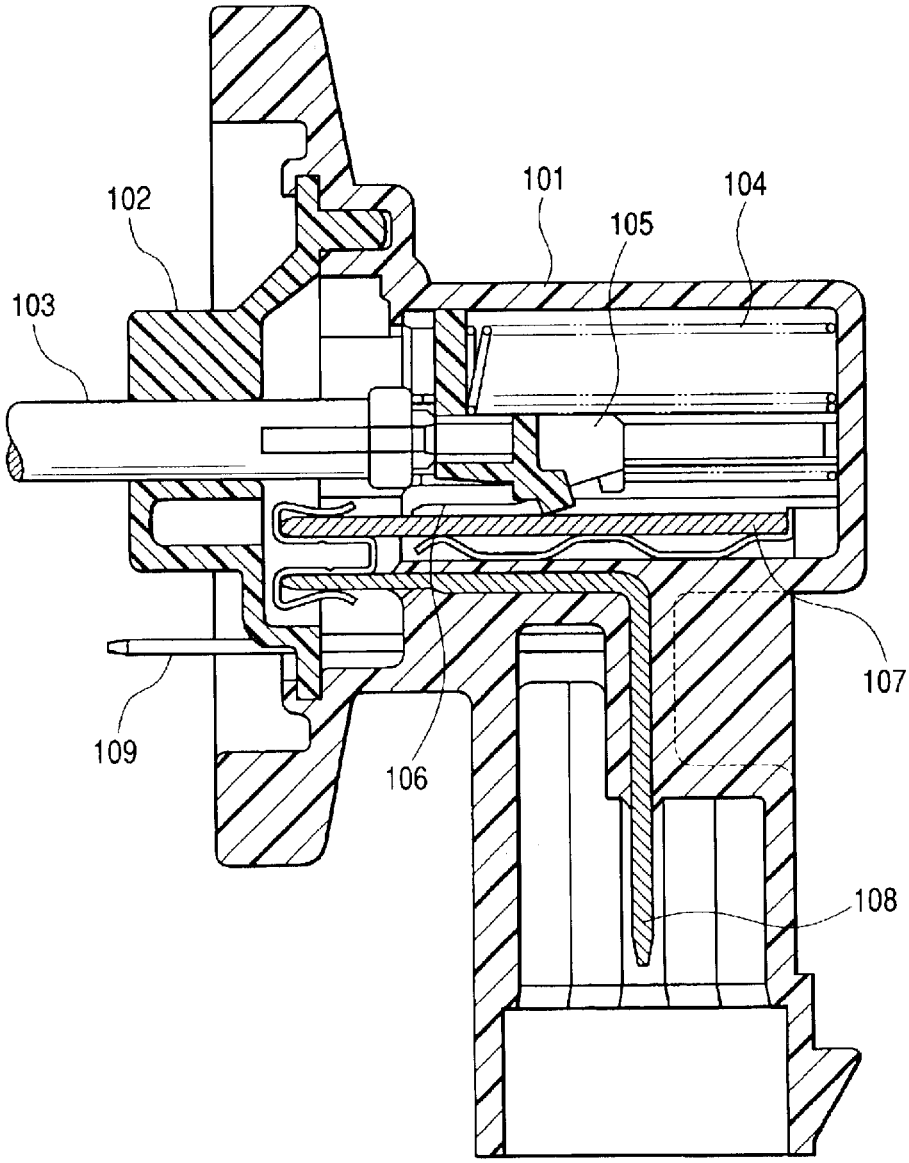
FIG. 6 PRIOR ART
FIG. 6 is a sectional view of an EGR sensor according to a related art.
Figure 7B:
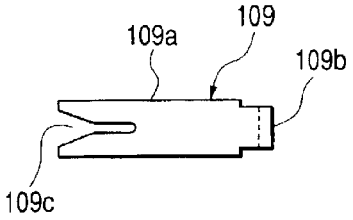
FIG. 7B PRIOR ART
FIGS. 7A to 7C are plan and side views of a terminal plate to be insert-molded to the EGR sensor of the related art.
Figure 7A:
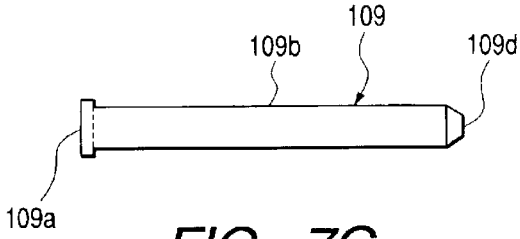
FIG. 7A PRIOR ART
Figure 7C:
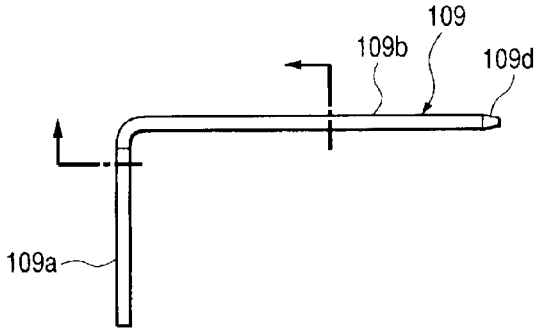
FIG. 7C PRIOR ART
Figure 8:
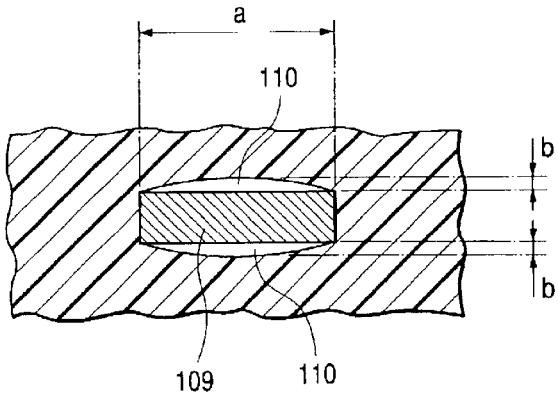
FIG. 8 PRIOR ART
FIG. 8 is a sectional view showing a trouble in the EGR sensor of the related art.

As shown in FIG. 1, the EGR sensor of the embodiment basically similar in structure to the related-art EGR sensor shown in FIG. 6, is structured with a housing 1 made of a synthetic resin, a cover 2 provided on an aperture of the housing 1, an operating shaft 3 slidably attached to the cover 2, a return spring 4 provided in the housing 1 and usually urging the operating shaft 3 toward the outward, a slider receiver 5 provided at an inner end of the operating shaft 3, a slider 6 attached to the slider receiver 5, a resistance board 7 provided in the housing 1 by which the slider 6 is slid, a signal-transmission terminal plate 8 made of a metal having an intermediate part inserted in the housing 1 and one end connected to the resistance board 7, and a power-feed terminal plate 9 made of a metal having an intermediate part insert-molded in the housing 1 and both ends projecting outward of an end surface of the housing 1.

The housing 1 is made by an attaching part 11 in a shallow dish form, a container part 12 in a bottomed cylinder form and a terminal-plate setting part 13 in a block form, and formed in one body through an insulating synthetic resin material. The attaching part 11 has a positioning projection 14 projecting in its bottom surface. As shown in FIG. 3, by fitting the positioning projection 14 in a positioning hole 112 formed in a control-valve container 111, the EGR sensor can be attached to a predetermined position of the control-valve container 111. Meanwhile, the container 12, at its aperture side, is formed with a cover engaging part 15 to attach the cover 2 thereon. Furthermore, the container 12, at its bottom inner surface, is projected with a spring-holding projection 16 to hold one end of the return spring 4, a stopper 17 for restricting the moving range of the slider 5, and a board holding part 18 for restricting a set position of the resistance board 7, whereby the return spring 4, the slider receiver 5, the slider 6 and the resistance board 7 are accommodated in a predetermined arrangement.

The cover 2 is formed in one body of an insulating synthetic resin material, and opened with a bearing bore 21 to slidably hold the operating shaft 3 in a center thereof and provided with an engaging projection 22 to attach it to the housing 1 in the periphery thereof. By engaging the engaging projection 22 with the cover engaging part 15 formed on the housing 1, the cover 2 is attached to the container 12 at its opening side.

The operating shaft 3 is penetrated through the bearing bore 21 opened in the cover 2 and axially slidably held therein. Besides, the operating shaft 3 has a flange 23 projecting at the inner end thereof.

The slider receiver 5 is made by a slider setting section 24 to set the slider 6 and a spring holding part 25 to hold one end of the return spring 4, which is formed in one body by an insulating synthetic resin material. The slider receiver 5 is abutted by the flange 23 provided projecting at the inner end of the operating shaft 3.

The return spring 4, structured by a coiled spring, is stretched between the spring holding projection 16 formed on the housing 1 and the spring holding part 25 formed on the slider receiver 5, thereby urging the operating shaft 3 toward the outward at all times.

The resistance board 7 is formed with a required pattern of resistance and current-collector layers and a terminal pattern in electrical connection to the resistance and current-collector layers on the surface of an unillustrated insulating plate. Incidentally, the resistance layer, current collector layer and terminal pattern, belongs to the known matter not constituting a gist of the invention, hence being omittedly shown. A leaf spring 26 is interposed between the lower surface of the resistance board 7 and the inner surface of the container 12. The resistance board 7 is always urged upward by the elastic force of the leaf spring 26.

The slider 6 is formed of a good conductor excellent in elasticity, e.g. phosphor bronze, to have one end firmly fixed to the slider receiver 5 and the other end placed in elastic contact with the resistance and current-collector layers formed on the resistance board 7. Consequently, the slider 6 and the resistance board 7 are positively placed in elastic contact by the elastic force of the slider 6 and the elastic force of the leaf spring 26. In the event of undergoing an external force such as vibrations, electrical connection is positively secured between the slider 6 and the resistance board 7. The slider 6 and the resistance board 7 constitute position detecting means for detecting a position of the operating shaft 3.

The signal-transmission terminal plate 8, formed of a good conductor e.g. brass, has the intermediate portion insert-molded in the housing 1 so that its both ends project outwardly from an end surface of the terminal-plate setting part 13. The signal-transmission terminal plate 8, at one end, is connected with the terminal pattern of the resistance board through a clip terminal 27 as shown in FIG. 1.

The power-feed terminal plate 9, also formed of a good conductor e.g. brass, has an intermediate portion insert-molded in the housing 1 and both ends projecting outward of an end surface of the terminal-plate setting part 13. As shown in FIGS. 2A, 2B and 2C, the power-feed terminal plate 9 of this embodiment is constituted by a wide portion 31 formed in an intermediate region and narrow portions 32 connected to the respective ends thereof with respect to a lengthwise direction thereof. The wide portion 31 is opened, lengthwise of the power-feed terminal plate 9, with an elongate blank hole 33 having an inner peripheral surface parallel with the side shape thereof. By the blank hole 33, two divisional parts 34, 35 are formed. The two split parts 34, 35 have widths s1 each formed narrower than a width s2 of the narrow portion 32. The two divisional portions 34, 35 are formed in a total width (s1×2) equal to the width s2 of the narrow portion 32. Also, on the main and back surfaces of the divisional portion 34, 35, a plurality of grooves 36 are formed extending in a direction perpendicular to the lengthwise direction of the power-feed terminal plate 9. Furthermore, the narrow portion 32, at its one end, is formed with a slit 37 for inserting therein a terminal member (not shown) provided on one mating connector device. The narrow portion 32, at its other end, is formed with a chamfer 38 for easy insertion over the terminal member (not shown) provided on the other mating connector device. The power-feed terminal plate 9 is bent rectangular at a point of the wide portion 31 close to the narrow portion 32 having the slits 37. In the range shown by the arrows in FIG. 2C, insert-molding is made by the housing 1.

The EGR sensor of this embodiment is to be built in the EGR system, as shown in FIG. 3, by fitting the positioning projection 14 formed on the housing 1 in the positioning hole 112 formed in the control-valve container 111 and attaching the attaching part 11 to the outer surface of the control-valve container 111 through an attaching means 113 such as a fastener. In the valve-control container 111, there are provided a recycling pipe 114 for emission gas and emission-gas regulating means 115 for regulating the recycling amount of the emission gas to be supplied toward the air intake of a gasoline engine by the recycling pipe 114. The emission-gas regulating means 115 is structured with a valve stem 116 formed at a tip of the recycling pipe 114, a valve body 117 for opening and closing the valve stem 116, and an actuator 118, such as a solenoid, for regulating the opening degree of the valve body 117 relative to the valve stem 116. An EGR valve is structured by the valve stem 116 and the valve body 117. The operating shaft 3 provided in the EGR sensor is placed in elastic contact with the valve body 117 by the elastic force of the return spring 4. Meanwhile, as shown in FIG. 3, the signal-transmission terminal plate 8 is connected to a control section 120 while the power-feed terminal plate 9 is connected to the actuator 118 and a power-supply circuit 121.

The EGR sensor of this embodiment regulates the power to be supplied from the power supply circuit 121 to the actuator 118, and adjusts a recycle amount of the emission gas to be supplied toward the air intake of the gasoline engine. Namely, in case control is carried out for emission-gas circulation, the valve body 117 moves in a direction of the arrow A against the elastic force of the return spring 4 to thereby push the operating shaft 3 in the housing 1. Consequently, changed is the contact position between the slider 6 and the resistance and current-collector layers formed on the resistance board 7, thereby changing a resistance value to be detected from the resistance board 7. The control section 120 detects a resistance value from the resistance board 7 and determines whether or not the detected resistance value is a resistance value required to recycle a desired amount of emission gas toward the air intake of gasoline engine. In the case of a determination that the detected resistance value is not a resistance value required to recycle a desired amount of emission gas toward the air intake of gasoline engine, the power from the power supply circuit 121 is supplied to the actuator 118 through the power-feed terminal plate 9, thereby driving the valve body 117 in an A-direction or a B-direction opposite thereto. This regulates to a predetermined value the recycle amount of the emission gas to be supplied toward the air intake of gasoline engine.

In the EGR sensor of this embodiment, as described before, the insert-mold portion (wide portion 31) of the power-feed terminal plate 9 is opened with an elongate blank hole 33 extending in the lengthwise direction of the power-feed terminal plate 9, to form, on both sides, the divisional parts 34, 35 narrower than the width s2 of the narrow portion 32 and a plurality of grooves 36 on the main and back surfaces of divisional parts 34, 35 extending in a direction perpendicular to a widthwise direction of the power-feed terminal plate 9. As apparent from a comparison between FIG. 4A and FIG. 4B, it is possible to reduce the size of a clearance 110 formed on the main and back surfaces of the power-feed terminal plate 9 due to a cure contraction of synthetic resin, providing high air-tightness as compared to the related-art EGR sensor.

Incidentally, the EGR sensor of this embodiment and the EGR sensor of the related art were attached on an air-tightness tester, to impose a load of a pressure of 100 kPa to the housing 1 at its attaching part 11 side. On the EGR sensor 10 of the related art, the pressure at the attaching part 11 side lowered by 600 Pa after 10 seconds whereas, on the EGR sensor of the embodiment, the pressure drop at the attaching part 11 side stays at 300 Pa after 1 hour. It was confirmed that there was an effect in improving air-tightness. Meanwhile, differently from the above embodiment, similar air-tightness tests were conducted on a case of opening an elongate blank hole extending in a direction perpendicular to the lengthwise direction of the power-feed terminal plate 9 and forming divisional parts 34, 35 on the both sides thereof, a case of forming only one strip of groove 36 on the main and back surfaces of the divisional parts 34, 35 and a case of omitting the grooves 36 on the main and back surfaces of the divisional parts 34, 35. It was confirmed that each of the EGR sensors of this embodiment has high air-tightness as compared to the EGR sensor of the related art.

Furthermore, in the EGR sensor of this embodiment, because the two divisional parts 34, 35 are formed in a total width (s1×2) equal to a width s2 of the narrow part 32, it is possible to secure an amount of the power to be supplied to the actuator 118. The EGR sensor can be prevented against performance deterioration.

Figure 5A:
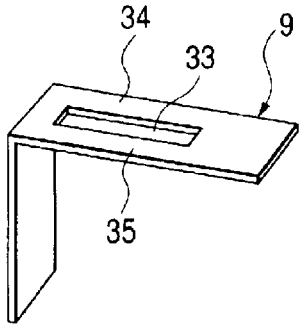
FIGS. 5A to 5F are perspective views showing the structures of other terminal plates that can be insert-molded to an EGR sensor of the embodiment.
Figure 5B:
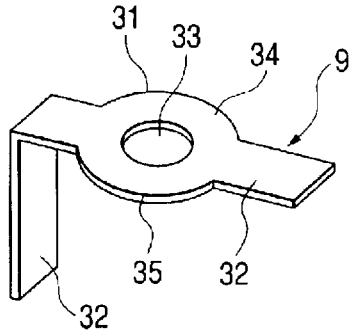
Figure 5C:
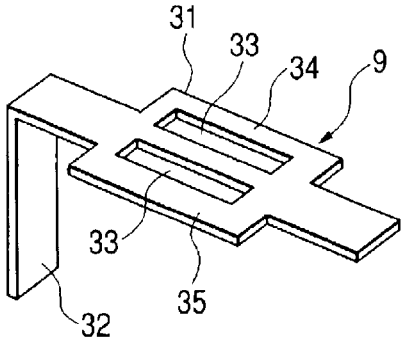
Figure 5D:
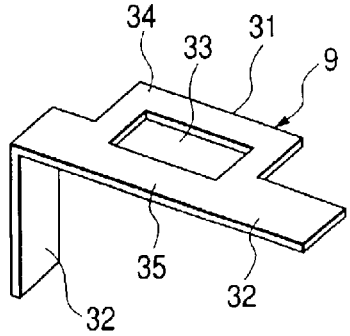
Figure 5E:
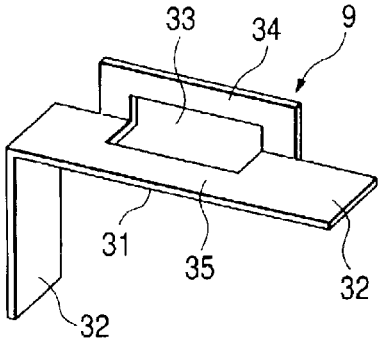
Figure 5F:
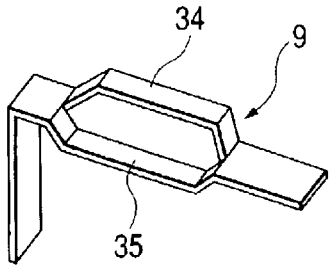

Incidentally, in the foregoing embodiment, the power-feed terminal plate 9 used the one shown in FIG. 2. However, the gist of the invention is not limited to that but can, of course, use another form of power-feed terminal plate 9. FIGS. 5A–5F exemplifies another power-feed terminal plate 9 applicable to the EGR sensor of the invention. The terminal plate 9 in FIG. 5A is on an example that the entire is formed nearly in an equal width without providing a wide portion 31. The terminal plate 9 in FIG. 5B is on an example that the wide portion 31 is formed circular to open a circular blank hole 33 in the circular wide portion 31. The terminal plate 9 in FIG. 5C is on an example that two strips of blank holes 33 are formed in parallel in the wide portion 31 thereby forming three strips of narrow portions. The terminal plate 9 in FIG. 5D is on an example that the wide portion 31 and the narrow portion 32 are aligned at their one sides thereby extending the wide portion 31 toward one side of the narrow portion 32. The terminal plate 9 in FIG. 5E is on an example that the wide portion 31 and the narrow portion 32 are aligned at their one sides thereby extending the wide portion 31 toward one side of the narrow portion 32 and bending rectangular the extended part of wide portion 31. The terminal plate 9 in FIG. 5F is on an example that a lengthwise extending slit is formed in a central region of the terminal plate to form two strips of narrow portions 32 one of which is curved upward and the other is curved downward. In the case of using each of these terminal plates 9, it is possible to obtain an effect similar to that of the EGR sensor of the foregoing embodiment.

Besides, although the foregoing embodiment was structured to improve air-tightness on the power-feed terminal plate 9, the signal-transmission terminal plate 8 can be improved in air-tightness by being made in the same structure as the foregoing.

Meanwhile, although the foregoing embodiment exemplified the EGR sensor, application is possible to every connector device in which the pressure is exerted to an insert-mold part of a terminal plate.

As explained above, the connector device of the present invention opened a required blank hole or slit in the insert-mold part of the terminal plate and the divisional parts divided by the blank hole or slit are made narrower in width than the end of the terminal plate projecting at the end surface of the housing. Accordingly, it is possible to relatively reduce the size of the clearance formed on the main and back surfaces of the terminal plate, and hence to improve the air-tightness of the connector device.

Also, the EGR sensor of the present invention opened a required blank hole or slit in the insert-mold part of the terminal plate and the divisional parts divided by the blank hole or slit are made narrower in width than the end of the terminal plate projecting at the end surface of the housing. Accordingly, it is possible to relatively reduce the size of the clearance formed on the main and back surfaces of the terminal plate, and hence to improve the air-tightness of the EGR sensor.

What is claimed is:

1. A connector device comprising:

a housing made of a synthetic resin; and a terminal plate made of a metal having an intermediate portion insert-molded in the housing and both ends projecting at different end surfaces of the housing;

wherein an insert-mold part of the terminal plate is opened with a blank hole having an inner peripheral surface parallel with a side shape of the insert-mold part, to have divisional parts divided by the blank hole, wherein the divisional parts are formed narrower in width than the both ends, wherein the blank hole has an elongated shape in a lengthwise direction given in parallel with a lengthwise direction of the terminal plate, and wherein a plurality of grooves are formed extending in a direction to intersect the hole and perpendicular to the lengthwise direction of the terminal plate, on main and back surfaces of the divisional parts.

2. A connector device according to claim 1, wherein the divisional parts have a total width given equal to a width of the end projecting at the end surface of the housing.

3. An EGR sensor comprising:

a housing made of a synthetic resin;

an operating shaft slidably attached on the housing;

position detecting means for detecting a position of the operating shaft; and a terminal plate made of a metal having an intermediate portion insert-molded in the housing and both ends projecting at different end surfaces of the housing;

wherein an insert-mold part of the terminal plate is opened with a blank hole having an inner peripheral surface parallel with a side shape of the insert-mold part, to have divisional parts divided by the blank hole, wherein the divisional parts are formed narrower in width than the both ends, wherein the blank hole has an elongated shape in a lengthwise direction given in parallel with a lengthwise direction of the terminal plate, and wherein one to a plurality of grooves are formed extending in a direction, to intersect the hole and perpendicular to the lengthwise direction of the terminal plate, on main and back surfaces of the divisional parts.

* * * * *